US011280003B2

(12) United States Patent
Terashima et al.

(10) Patent No.: US 11,280,003 B2
(45) Date of Patent: Mar. 22, 2022

(54) COATED METAL, COATING-FORMING TREATMENT SOLUTION, AND METHOD FOR PRODUCING COATED METAL

(71) Applicant: JFE Steel Corporation, Tokyo (JP)

(72) Inventors: Takashi Terashima, Tokyo (JP); Makoto Watanabe, Tokyo (JP); Toshito Takamiya, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 346 days.

(21) Appl. No.: 16/325,014

(22) PCT Filed: Aug. 21, 2017

(86) PCT No.: PCT/JP2017/029699
§ 371 (c)(1),
(2) Date: Feb. 12, 2019

(87) PCT Pub. No.: WO2018/043167
PCT Pub. Date: Mar. 8, 2018

(65) Prior Publication Data

US 2019/0226093 A1 Jul. 25, 2019

(30) Foreign Application Priority Data

Aug. 30, 2016 (JP) ..... 2016-168256

(51) Int. Cl.
*C23C 22/07* (2006.01)
*H01F 1/18* (2006.01)
(Continued)

(52) U.S. Cl.
CPC ..... *C23C 22/07* (2013.01); *C23C 22/12* (2013.01); *C23C 22/188* (2013.01); *C23C 22/20* (2013.01);
(Continued)

(58) Field of Classification Search
None
See application file for complete search history.

(56) References Cited

U.S. PATENT DOCUMENTS

| | | | |
|---|---|---|---|
| 8,409,370 | B2 | 4/2013 | Takashima et al. |
| 8,535,455 | B2 | 9/2013 | Takashima et al. |
| 2018/0080127 | A1 | 3/2018 | Terashima et al. |

FOREIGN PATENT DOCUMENTS

| | | | |
|---|---|---|---|
| CN | 102947001 | A | 2/2013 |
| EP | 2182091 | A1 | 5/2010 |

(Continued)

OTHER PUBLICATIONS

International Search Report and Written Opinion for International Application No. PCT/JP2017/029699, dated Sep. 12, 2017—5 pages.

(Continued)

*Primary Examiner* — Lois L Zheng
(74) *Attorney, Agent, or Firm* — RatnerPrestia

(57) ABSTRACT

Provided are coated metal, the metal having improved properties due to a novel coating, a coating-forming treatment solution for forming the novel coating, and a method for producing the coated metal that has the novel coating. The coated metal includes metal and a coating formed on the metal. The coating includes Si, P, and O, and at least one selected from the group consisting of Mg, Ca, Ba, Sr, Zn, Al, and Mn. The coating includes a compound having a Na Super Ionic Conductor-type (NASICON-type) crystal structure represented by a general formula $M^{I}M^{IV}{}_{2}(M^{V}O_{4})_{3}$.

18 Claims, 1 Drawing Sheet

(51) Int. Cl.

| | |
|---|---|
| ***C23C 22/22*** | (2006.01) |
| ***C23C 22/18*** | (2006.01) |
| ***H01F 1/147*** | (2006.01) |
| ***C23C 22/74*** | (2006.01) |
| ***C23C 22/33*** | (2006.01) |
| ***C23C 22/20*** | (2006.01) |
| ***C23C 22/12*** | (2006.01) |

(52) U.S. Cl.

CPC ..... *C23C 22/22* (2013.01); *C23C 22/33* (2013.01); *C23C 22/74* (2013.01); *H01F 1/14783* (2013.01); *H01F 1/18* (2013.01)

(56) References Cited

FOREIGN PATENT DOCUMENTS

| | | | |
|---|---|---|---|
| EP | 2186924 | A1 | 5/2010 |
| EP | 2545992 | A1 | 1/2013 |
| EP | 2799594 | A1 | 11/2014 |
| EP | 2902509 | A1 | 8/2015 |
| JP | 2007217758 | A | 8/2007 |
| JP | 2012193251 | A | 10/2012 |
| KR | 20100049617 | A | 5/2010 |
| RU | 2431697 | C1 | 10/2011 |
| RU | 2431698 | C1 | 10/2011 |
| RU | 2580775 | C2 | 4/2016 |
| WO | 2013175733 | A1 | 11/2013 |
| WO | 2016158325 | A1 | 10/2016 |

OTHER PUBLICATIONS

Kishioka et al., "Sintering and Properties of $Na_{2x}Mg_1$—x—$Ti_4(PO_4)_6$ Prepared by Sol-Gel Process—Preparation of Ultra-Low Thermal Expansion Ceramics", Gypsum & Lime, vol. 1994, No. 251, 1994—pp. 260-265.

Korean Office Action for Korean Application No. 10-2019-/004197, dated Jun. 1, 2020, with Concise Statement of Relevance of Office Action, 6 pages.

Chinese Office Action with Search Report for Chinese Application No. 201780049490.6, dated May 25, 2020, 9 pages.

Extended European Search Report for European Application No. 17 846 175.2, dated Aug. 26, 2019, 7 pages.

Russian Office Action with Search Report for Russian Application No. 2019103954, dated Oct. 16, 2019, with translation, 13 pages.

COATED METAL, COATING-FORMING TREATMENT SOLUTION, AND METHOD FOR PRODUCING COATED METAL

CROSS REFERENCE TO RELATED APPLICATIONS

This is the U.S. National Phase application of PCT/JP2017/029699, filed Aug. 21, 2017, which claims priority to Japanese Patent Application No. 2016-168256, filed Aug. 30, 2016, the disclosures of these applications being incorporated herein by reference in their entireties for all purposes.

FIELD OF THE INVENTION

The present invention relates to coated metal, a coating-forming treatment solution, and a method for producing coated metal.

BACKGROUND OF THE INVENTION

The performance (properties) of metal products, such as steel sheets, can be enhanced, in some cases, by forming a coating on the metal and thereby forming coated metal. For example, in a coated electrical steel sheet disclosed in Patent Literature 1, the coating imparts tension to the steel sheet, thereby improving the magnetic properties of the coated electrical steel sheet.

PATENT LITERATURE

PTL 1: Japanese Unexamined Patent Application Publication No. 2007-217758

SUMMARY OF THE INVENTION

As described above, a coating can improve the performance of metal products. If a novel coating is discovered, even more useful metal products may be obtained. Accordingly, an object according to aspects of the present invention is to provide coated metal, the metal having improved properties due to a novel coating, a coating-forming treatment solution for forming the novel coating, and a method for producing the coated metal that has the novel coating.

To solve the problems described above, the present inventors paid particular attention to the components included in a coating and diligently performed studies. Consequently, it was found that a coating including Si, P, O, and at least one selected from the group consisting of Mg, Ca, Ba, Sr, Zn, Al, and Mn and including a compound having a NASICON-type crystal structure represented by the general formula $M^{I}M^{IV}{}_{2}(M^{V}O_{4})_{3}$ significantly contributes to improving the performance of metal products.

Aspects of the present invention were made based on the above findings, and specifically aspects of the present invention provide the following.

[1] Coated metal, the metal including metal and a coating formed on the metal, the coating including Si, P, and O, and at least one selected from the group consisting of Mg, Ca, Ba, Sr, Zn, Al, and Mn, the coating including a compound having a NASICON-type crystal structure represented by the general formula $M^{I}M^{IV}{}_{2}(M^{V}O_{4})_{3}$. In the general formula $M^{I}M^{IV}{}_{2}(M^{V}O_{4})_{3}$, $M^{I}$ is at least one selected from the group consisting of Li, Na, K, ½Mg, ½Ca, ½Sr, and ¼Zr, $M^{IV}$ is at least one selected from the group consisting of Zr, Ge, Ti, Hf, Cr+Na, Nb—Na, and Y+Na, and $M^{V}$ is at least one selected from the group consisting of P, As, and Si+Na.

[2] The coated metal according to [1], wherein the coating is a chromium-free coating, free of Cr.

[3] The coated metal according to [1] or [2], wherein the metal has a sheet shape.

[4] The coated metal according to [3], wherein the metal is a steel sheet.

[5] The coated metal according to [4], wherein the steel sheet is a grain-oriented electrical steel sheet.

[6] A coating-forming treatment solution including at least one metal phosphate selected from the group consisting of Mg, Ca, Ba, Sr, Zn, Al, and Mn, colloidal silica, and a compound having a NASICON-type crystal structure represented by the general formula $M^{I}M^{IV}{}_{2}(M^{V}O_{4})_{3}$. In the general formula $M^{I}M^{IV}{}_{2}(M^{V}O_{4})_{3}$, $M^{I}$ is at least one selected from the group consisting of Li, Na, K, ½Mg, ½Ca, ½Sr, and ¼Zr, $M^{IV}$ is at least one selected from the group consisting of Zr, Ge, Ti, Hf, Cr+Na, Nb—Na, and Y+Na, and $M^{V}$ is at least one selected from the group consisting of P, As, and Si+Na.

[7] A method for producing the coated metal according to any one of [1] to [5], the method including applying the coating-forming treatment solution according to [6] onto the metal and subjecting the metal to at least one heat treatment in a non-oxidizing atmosphere.

[8] A method for producing the coated metal according to any one of [1] to [5], the method including applying a coating-forming treatment solution onto the metal, the coating-forming treatment solution including at least one metal phosphate selected from the group consisting of Mg, Ca, Ba, Sr, Zn, Al, and Mn, colloidal silica, and a metal sol having a primary particle diameter of 100 nm or less, and after the application, subjecting the metal to at least one heat treatment in a non-oxidizing atmosphere, wherein the heat treatment is a process in which the metal is held in a temperature range of 600° C. or higher and 700° C. or lower for 10 seconds or more and 60 seconds or less, and, after the holding, baking is performed thereon at 800° C. or higher.

[9] A method for producing the coated metal according to any one of [1] to [5], the method including applying a glass-coating-forming treatment solution containing glass powder onto the metal, and thereafter, subjecting the metal to at least one heat treatment in a non-oxidizing atmosphere.

According to aspects of the present invention, a novel coating improves the properties of metal products.

DETAILED DESCRIPTION OF EMBODIMENTS OF THE INVENTION

Figure 1:
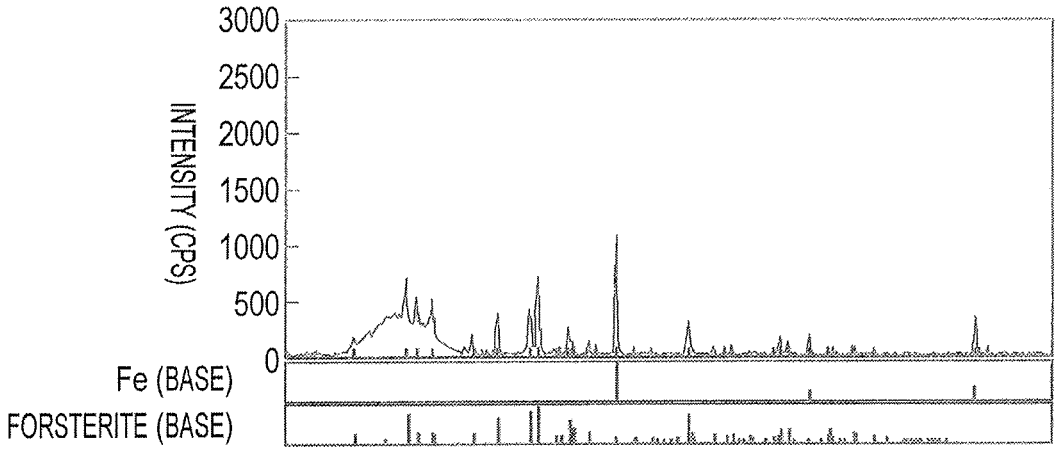
FIG. 1 is an exemplary chart illustrating the X-ray diffraction of a coating after a first heat treatment.

Embodiments of the present invention will be described below. The present invention is not limited to the embodiments below.

<Coated Metal>

According to aspects of the present invention, coated metal includes metal and a coating formed on the metal. In the following descriptions, the coating and the metal will be described in the order stated.

Coating

The coating formed on the metal includes Si, P, and O, and at least one selected from the group consisting of Mg, Ca, Ba, Sr, Zn, Al, and Mn and further includes a compound having a NASICON-type crystal structure represented by the general formula $M^{I}M^{IV}_{2}(M^{V}O_4)_3$.

Inclusion of Si, P, and O is necessary to form the network structure of Si—O—Si bonds (SiO network structure) and the network structure of P—O—P bonds (PO network structure). In the novel coating of the coated metal according to aspects of the present invention, the P content in the coating, on an oxide basis ($P_2O_5$ basis), is preferably not less than 10.0 mol % and more preferably not less than 15.0 mol %, for the lower limit. For the upper limit, the P content is preferably not greater than 36.0 mol % and more preferably not greater than 30.0 mol %. The Si content, on an oxide basis ($SiO_2$ basis), is preferably not less than 28.0 mol % and more preferably not less than 35.0 mol %. For the upper limit, the Si content is preferably not greater than 63.0 mol % and more preferably not greater than 60.0 mol %. When the above-mentioned ranges are satisfied, adhesion between the coating and the metal and moisture absorption resistance, for example, are maintained in good conditions.

It should be noted that the P content and the Si content described above are the total content of P and the total content of Si, respectively, in the coating, and thus the contents also respectively include the contents of P and Si included (in some cases, not included) in the compound represented by the general formula $M^{I}M^{IV}_{2}(M^{V}O_4)_3$, which will be described later.

The inclusion of at least one selected from the group consisting of Mg, Ca, Ba, Sr, Zn, Al, and Mn is intended to ensure that the SiO network structure and the PO network structure are stably present. To produce this effect, the total content (when only one of the elements is included, the content of the element), on an oxide basis, is preferably not less than 10.0 mol % and more preferably not less than 12.0 mol %, for the lower limit. For the upper limit, the content is preferably not greater than 40.0 mol % and more preferably not greater than 30.0 mol %. It should be noted that the total content described above is the total content of the components described above in the coating and thus also includes the content of Mg, Ca, or the like selectively included in the compound represented by the general formula $M^{I}M^{IV}_{2}(M^{V}O_4)_3$, which will be described later.

Compounds having a NASICON-type crystal structure represented by the general formula $M^{I}M^{IV}_{2}(M^{V}O_4)_3$ are known as ceramics having low thermal expansion properties, as described in Published document 1 (Nyuu Seramikkusu (New Ceramics), Vol. 8, No. 1, p. 31 to 38 (1995)) and Published document 2 (Sekko to Sekkai (Gypsum & Lime), Vol. 1994, No. 251, p. 260 to 265 (1994)), for example.

In the general formula $M^{I}M^{IV}_{2}(M^{V}O_4)_3$, $M^{I}$ is at least one selected from the group consisting of Li, Na, K, ½Mg, ½Ca, ½Sr, and ¼Zr. $M^{IV}$ is at least one selected from the group consisting of Zr, Ge, Ti, Hf, Cr+Na, Nb—Na, and Y+Na. $M^{V}$ is at least one selected from the group consisting of P, As, and Si+Na.

The content of the metal element represented by $M^{IV}$ in the coating, on an oxide basis, is preferably not less than 0.3 mol % and more preferably not less than 1.0 mol %, for the lower limit. For the upper limit, the content is preferably not greater than 25.0 mol %. It is believed that, when these ranges are satisfied, a sufficient amount of a compound having a NASICON-type crystal structure represented by the general formula $M^{I}M^{IV}_{2}(M^{V}O_4)_3$ for improving the properties of metal products is formed.

By including Si, P, and O, and at least one selected from the group consisting of Mg, Ca, Ba, Sr, Zn, Al, and Mn and including, in combination with this, the above-described compound widely known as a ceramic having low thermal expansion properties, the properties of the coated metal can be improved.

The coating weight of the coating may be appropriately set in accordance with, for example, the intended use, but it is preferable that the dried coating weight on both sides in total be 0.15 to 20.0 g/m$^2$. The reason is that, if the coating weight is less than 0.15 g/m$^2$, ensuring a uniform coverage may be difficult, whereas, if the coating weight is greater than 20.0 g/m$^2$, adhesion may decrease. It is preferable that the lower limit not be less than 4.0 g/m$^2$. It is preferable that the upper limit not be greater than 15.0 g/m$^2$.

The coverage of the coating over the entire surface of the metal is not particularly limited and may be appropriately set in accordance with, for example, the intended use. When the metal has a sheet shape, it is preferable that the coating be formed over the entirety of the front side and the back side.

Metal

As described above, in accordance with aspects of the present invention, one feature is that the novel coating improves properties, and therefore the type of the metal is not particularly limited. In addition, the shape of the metal is not particularly limited, either, but a sheet shape is preferable.

Other Layers

The coating may be formed on or over the metal. For example, another layer may be present between the metal and the coating. The coating may be formed directly on the metal.

<Coating-Forming Treatment Solution>

A coating-forming treatment solution according to aspects of the present invention is a treatment solution for forming the coating of the coated metal according to aspects of the present invention and includes at least one metal phosphate selected from the group consisting of Mg, Ca, Ba, Sr, Zn, Al, and Mn, colloidal silica, and a compound having a NASICON-type crystal structure represented by the general formula $M^{I}M^{IV}_{2}(M^{V}O_4)_3$. The expression "at least one metal phosphate selected from the group consisting of Mg, Ca, Ba, Sr, Zn, Al, and Mn" means at least one metal phosphate selected from the group consisting of Mg phosphate, Ca phosphate, Ba phosphate, Sr phosphate, Zn phosphate, Al phosphate, and Mn phosphate.

It is preferable that the content of the at least one metal phosphate selected from the group consisting of Mg, Ca, Ba, Sr, Zn, Al, and Mn be 30.0 to 65.0 mass % on the basis of solids of the metal phosphate relative to the total solids in the treatment solution. When the range is satisfied, at least one selected from the group consisting of Mg, Ca, Ba, Sr, Zn, Al, and Mn sufficiently produces the effect of stabilizing the SiO network structure and the PO network structure, which is preferable. In addition, phosphorus in the metal phosphate is used to form the PO network structure. With regard to the type of the phosphate, a primary phosphate (biphosphate) is preferable because of its availability.

The colloidal silica is not particularly limited provided that the stability and compatibility of the solution (treatment solution) are achieved. Examples of the colloidal silica that may be used include acidic-type colloidal silicas (e.g., ST-O, commercially available (manufactured by Nissan Chemical Corporation, $SiO_2$ content: 20 mass %)) and alkaline-type colloidal silicas. It is preferable that the content of the colloidal silica in the treatment solution be 20.0 to 60.0 mass % on a solid basis (content relative to the total solid content)

so as to form a sufficient amount of SiO network structure. In addition, for the lower limit, the content of the colloidal silica is preferably not less than 40 parts by mass, more preferably not less than 50 parts by mass, and even more preferably not less than 60 parts by mass, per 100 parts by mass of the phosphate. For the upper limit, the content is preferably not greater than 200 parts by mass, preferably not greater than 180 parts by mass, and even more preferably not greater than 150 parts by mass.

The compound having a NASICON-type crystal structure represented by the general formula $M^{I}M^{IV}_{2}(M^{V}O_4)_3$ may be produced using a known method or may be a commercially available product, or, after the treatment solution is formulated and before the coating is formed, the NASICON-type crystal structure may be formed. It is preferable that the content of the compound in the treatment solution be 5.0 to 50.0 mass % relative to the total solid content of the treatment solution from the standpoint of improving the properties of metal products. In addition, the content of the compound, for the lower limit, is preferably not less than 1 part by mass, more preferably not less than 5 parts by mass, and even more preferably not less than 8 parts by mass, per 100 parts by mass of the phosphate. For the upper limit, the content is preferably not greater than 60 parts by mass, preferably not greater than 50 parts by mass, and even more preferably not greater than 40 parts by mass. In addition, to enable uniform dispersion of the compound in the treatment solution, the average particle diameter of the crystal of the compound is preferably not greater than 5 μm and more preferably not greater than 1 μm, as determined by laser diffractometry. In addition, in many cases, the lower limit of the average particle diameter is not less than 0.10 μm.

The method for producing the coating-forming treatment solution according to aspects of the present invention is not particularly limited. The treatment solution containing the components described above may be, for example, an aqueous solution prepared using a known method. The concentration of the treatment solution according to aspects of the present invention is not particularly limited, and the solid concentration may be appropriately set in accordance with, for example, the coating method and viscosity, so that the target coating weight can be easily achieved.

<Method for Producing Coated Metal>

The method for producing coated metal according to aspects of the present invention will be described with reference to three embodiments, by way of example.

First Embodiment

The production method of the first embodiment is a method for producing the coated metal according to aspects of the present invention by using the above-described treatment solution according to aspects of the present invention. Specifically, the method is a method for producing coated metal performed as follows. The above-described coating-forming treatment solution is applied onto metal, and at least one heat treatment is performed in a non-oxidizing atmosphere. Preferable conditions will be described below.

The coating method for applying the coating-forming treatment solution onto metal is not particularly limited, and an optimal method may be appropriately employed in accordance with, for example, the shape of the metal. Examples of the method include roll coating methods, bar coating methods, dip coating methods, and spray coating methods. The amount of coating may be appropriately set in accordance with, for example, the target coating weight of the coating to be formed and is typically assumed to be an amount corresponding to a dried coating weight of 0.15 to 20.0 g/m$^2$. Before the application of the treatment solution, one or more additional processes, such as pickling and degreasing, may be performed. The one or more additional processes may include a process for forming another layer on the metal.

After the treatment solution is applied onto metal, at least one heat treatment is performed in a non-oxidizing atmosphere. The heating method is not particularly limited provided that a non-oxidizing atmosphere is used. Examples of the method include methods using a radiant tube heating furnace and methods using an induction heating furnace.

The non-oxidizing atmosphere is, for example, an inert atmosphere of inert gas, such as nitrogen gas or argon gas, or a reducing atmosphere of, for example, hydrogen. A drying process for removing moisture may be performed preliminarily in, for example, a drying furnace with an uncontrolled atmosphere provided that the process is performed at a temperature and duration that do not cause the problem of oxidation. After this, the predetermined heat treatment may be performed in a non-oxidizing atmosphere.

The heat treatment serves as a baking process for forming a coating, and the temperature for the heat treatment and the duration of the heat treatment may be appropriately set so that good moisture absorption resistance, for example, can be achieved. Specifically, it is believed that the conditions of 700 to 1000° C. and 5 to 300 seconds are typical and preferable. The heat treatment is not limited to a single heat treatment, and two or more heat treatments may be performed.

Second Embodiment

The production method of the second embodiment is a method using a coating-forming treatment solution that includes at least one metal phosphate selected from the group consisting of Mg, Ca, Ba, Sr, Zn, Al, and Mn, colloidal silica, and a metal sol having a primary particle diameter of 100 nm or less.

The metal phosphate and the colloidal silica are the same as those of the first embodiment, and thus their descriptions are omitted.

With regard to the compound having a NASICON-type crystal structure represented by the general formula $M^{I}M^{IV}_{2}(M^{V}O_4)_3$, it is sufficient that the crystal structure be formed by the end of the heat treatment. Accordingly, the NASICON-type crystal represented by the general formula $M^{I}M^{IV}_{2}(M^{V}O_4)_3$ may be formed by using a metal sol as the material of $M^{IV}$ and supplying $M^{I}$ and $M^{V}$ from the phosphate. Examples of the material of $M^{IV}$ include $TiO_2$ sols, $ZrO_2$ sols, $GeO_2$ sols, $HfO_2$ sols, and $Nb_2O_3$ sols.

It is necessary that the metal sol have a primary particle diameter of 100 nm or less. It is necessary that the metal sol be reacted with P for amorphization during the time after the treatment solution is applied onto metal and before the coating solution dries and reaches 600° C. in the heat treatment. For this reason, the primary particle diameter is preferably as small as possible and specifically needs to be 100 nm or less. The lower limit of the primary particle diameter is not particularly limited but is typically 1 nm or greater. The primary particle diameter can be measured using a dynamic light scattering method. It is preferable that the metal sol be an amorphous sol.

With regard to the metal sol content of the treatment solution, an appropriate amount corresponding to the stoichiometric ratio may be added so that the compound described above can be sufficiently formed.

The method for producing the treatment solution described above is not particularly limited. The treatment solution containing the components described above may be, for example, an aqueous solution prepared by using a known method. The concentration of the treatment solution is not particularly limited, and the solid concentration may be appropriately set in accordance with, for example, the coating method and viscosity, so that the target coating weight can be easily achieved.

In the production method of the second embodiment, at least one heat treatment is performed in a non-oxidizing atmosphere after the treatment solution is applied onto metal. The heat treatment is a process including holding in a temperature range of 600° C. or higher and 700° C. or lower for 10 seconds or more and 60 seconds or less and baking at 800° C. or higher after the holding. In the case that two or more heat treatments are performed, it is sufficient that at least one of the treatments be a heat treatment performed under the above conditions, but it is preferable that the first heat treatment be performed under the conditions.

The coating method for applying the treatment solution onto metal is not particularly limited, and an optimal method may be appropriately employed in accordance with, for example, the shape of the metal. Examples of the method include roll coating methods, bar coating methods, dip coating methods, and spray coating methods. The amount of coating may be appropriately set in accordance with, for example, the target coating weight of the coating to be formed and is typically assumed to be an amount corresponding to a dried coating weight on both sides in total of 0.15 to 20.0 g/m$^2$. Before the application of the treatment solution, one or more additional processes, such as pickling and degreasing, may be performed. The one or more additional processes may include a process for forming another layer on the metal.

The method for performing the at least one heat treatment in a non-oxidizing atmosphere after the treatment solution is applied onto metal will be described.

The heating method is not particularly limited provided that a non-oxidizing atmosphere is used. Examples of the method include methods using a radiant tube heating furnace and methods using an induction heating furnace.

The non-oxidizing atmosphere is, for example, an inert atmosphere of inert gas, such as nitrogen gas or argon gas, or a reducing atmosphere of, for example, hydrogen. A drying process for removing moisture may be performed preliminarily in, for example, a drying furnace with an uncontrolled atmosphere provided that the process is performed at a temperature and duration that do not cause the problem of oxidation. After this, the predetermined heat treatment may be performed in a non-oxidizing atmosphere.

The heat treatment has two roles. For one thing, it is a baking process for forming a coating, and, for the other, it is a crystallization process for forming a compound having a NASICON-type crystal structure represented by the general formula $M^{I}M^{IV}{}_{2}(M^{V}O_4)_3$ in the coating. For these two roles, the heat treatment is a treatment including holding in a temperature range of 600° C. or higher and 700° C. or lower for 10 seconds or more and 60 seconds or less and baking at 800° C. or higher after the holding. If the temperature range for holding is lower than 600° C., substantially no crystal nuclei form, and if the temperature range for holding is higher than 700° C., crystallization begins at a stage at which nucleation is insufficient. As a result, the compound having a desired crystal structure cannot be easily formed. In addition, if the duration of holding is less than 10 seconds, sufficient nucleation is not achieved. If the duration of holding is greater than 60 seconds, problems, such as a decrease in productivity, arise. Further, the baking after the holding needs to be performed at 800° C. or higher. If the temperature is lower than 800° C., the desired coating is not formed. The upper limit of the temperature for the baking is not particularly limited but is preferably not higher than 1000° C. Further, it is preferable that the duration of the baking be 5 to 300 seconds.

Third Embodiment

The production method of the third embodiment is a method using a glass-coating-forming treatment solution containing glass powder. For the glass powder, a typical method for producing glass powder (glass frit) may be employed. For example, a predetermined glass frit is obtained by mixing various ingredients such that a predetermined composition of the glass frit is obtained and performing melting, vitrification, pulverizing, drying, and classification.

The production method of the third embodiment is also a method for producing coated metal according to aspects of the present invention. Accordingly, the "predetermined composition of the glass frit" denotes a composition determined to eventually obtain a coating including Si, P, and O, and at least one selected from the group consisting of Mg, Ca, Ba, Sr, Zn, Al, and Mn and including a compound having a NASICON-type crystal structure represented by the general formula $M^{I}M^{IV}{}_{2}(M^{V}O_4)_3$.

Examples of the ingredients for producing the glass frit include metal phosphates, such as magnesium phosphate, colloidal silica, metal oxides, such as titanium oxide, and phosphorus compounds, such as orthophosphoric acid. By appropriately selecting the metal of a metal phosphate or a metal oxide, glass frit for forming the above-described coating can be produced. In addition, water-insoluble components can be used, and therefore there is a wide choice of components that can be used, which is advantageous.

The size of the glass frit is not particularly limited, but it is preferable that the 90% particle diameter be 1.0 μm or greater and 10.0 μm or less.

The glass-coating-forming treatment solution is a treatment solution obtained by dispersing the glass frit in a solvent. The method for producing the solution is not particularly limited, and the treatment solution may be prepared by dispersing the glass frit in water, for example, by using a known method. The concentration of the treatment solution is not particularly limited, and the solid concentration may be appropriately set in accordance with, for example, the coating method and viscosity, so that the target coating weight can be easily achieved.

In the production method of the third embodiment, at least one heat treatment is performed in a non-oxidizing atmosphere after the glass-coating-forming treatment solution is applied onto metal.

The coating method for applying the treatment solution onto metal is not particularly limited, and an optimal method may be appropriately employed in accordance with, for example, the shape of the metal. Examples of the method include roll coating methods, bar coating methods, dip coating methods, and spray coating methods. The amount of coating may be appropriately set in accordance with, for example, the target coating weight of the coating to be formed and is typically assumed to be an amount corresponding to a dried coating weight on both sides in total of 0.15 to 20.0 g/m$^2$. Before the application of the treatment solution, one or more additional processes, such as pickling and degreasing, may be performed. The one or more additional processes may include a process for forming another layer on the metal.

The method for performing the at least one heat treatment in a non-oxidizing atmosphere after the treatment solution is applied onto metal will be described.

The heating method is not particularly limited provided that a non-oxidizing atmosphere is used. Examples of the method include methods using a radiant tube heating furnace and methods using an induction heating furnace.

The non-oxidizing atmosphere is, for example, an inert atmosphere of inert gas, such as nitrogen gas or argon gas, or a reducing atmosphere of, for example, hydrogen. A drying process for removing moisture may be performed preliminarily in, for example, a drying furnace with an uncontrolled atmosphere provided that the process is performed at a temperature and duration that do not cause the problem of oxidation. After this, the predetermined heat treatment may be performed in a non-oxidizing atmosphere.

The heat treatment has two roles. For one thing, it is a firing process for forming a glass coating, and, for the other, it is a crystallization process for forming a compound having a NASICON-type crystal structure represented by the general formula $M^{I}M^{IV}_{2}(M^{V}O_{4})_{3}$ in the coating. The temperature for the heat treatment and the duration of the heat treatment necessary for the firing process for forming a glass coating may be appropriately set so that good moisture absorption resistance, for example, can be achieved. In many cases, the temperature is 800 to 1000° C., and the duration is 30 to 360 minutes. In some cases, however, heating conditions necessary for the firing process for forming a glass coating are insufficient to form the compound having a NASICON-type crystal structure represented by the general formula $M^{I}M^{IV}_{2}(M^{V}_{4})_{3}$. In such cases, another heat treatment may be performed so that the compound having a NASICON-type crystal structure represented by the general formula $M^{I}M^{IV}_{2}(M^{V}O_{4})_{3}$ can be formed. The temperature and the duration necessary for the crystallization process may be affected by the crystal structure and may be appropriately adjusted. However, heating at the glass transition temperature or higher is preferable. To promote both the baking process and the crystallization process with one heating operation, the heating is performed, in many cases, under the conditions of 800 to 1000° C. and 30 to 480 minutes.

The production methods of the first embodiment to the third embodiment are described in the descriptions above. The production methods of the second embodiment and the third embodiment, in each of which the crystal is formed during the formation of the coating, enable a finer and more uniform crystalline phase to be formed in the coating, which tends to result in good properties. Furthermore, in the third embodiment, the heat treatment for firing and crystallization takes more time than in the first embodiment and in the second embodiment, but since glass frit having a predetermined composition is prepared through melting at a high temperature and rapid quenching and then applied, the ingredients need not be water-soluble and the use of a sol (which typically tends to be expensive) is not necessary, and therefore a coating can be obtained easily even with a composition with which it is typically difficult to form a coating solution.

<Grain-Oriented Electrical Steel Sheet Having Chromium-Free Coating>

With regard to the usefulness of the coated metal according to aspects of the present invention, a grain-oriented electrical steel sheet having a chromium-free coating will be described by way of example. In the grain-oriented electrical steel sheet having a chromium-free coating, the coating of the coated metal is a chromium-free coating, and the metal thereof is a grain-oriented electrical steel sheet. The compound having a NASICON-type crystal structure represented by the general formula $M^{I}M^{IV}_{2}(M^{V}O_{4})_{3}$ may include Cr as described above. However, in the case that a chromium-free coating is to be formed, the compound does not include Cr. The reason for forming a chromium-free coating is its environmental friendliness. For environmental friendliness, it is preferable that the compound not include As, either.

Typically, grain-oriented electrical steel sheets include a coating on the surface so as to have insulating properties, workability, and anti-corrosion properties, for example. Such a surface coating includes a base coating and a top coating. The base coating primarily includes forsterite, which is formed during final annealing. The top coating is a phosphate-based coating formed on the base coating. In the description below, the top coating is referred to as the "coating" of the coated metal, and the forsterite coating, which is the base coating, is referred to as the "other layer" formed on the metal. In some cases, metal nitride (e.g., TiN or $Si_3N_4$), for example, is applied to the surface of the forsterite coating. In such cases, the other layer includes the metal nitride.

Such coatings are formed at high temperatures and have low coefficients of thermal expansion and therefore, when the temperature is lowered to room temperature, produce the effect of imparting tension to the steel sheet as a result of the difference in the coefficient of thermal expansion between the steel sheet and the coating and thereby reducing iron loss. Thus, it is desirable that as much tension as possible be imparted to the steel sheet. A known coating (top coating) that satisfies the demand is a coating containing chromic anhydride.

However, with the increasing concern for environmental protection in recent years, there is an increasing demand for developing products that do not contain toxic substances, such as chromium or lead. Chromium-free coatings, however, have problems of significantly-low moisture absorption resistance and insufficient imparting of tension and have a further problem of decreased thermal resistance. Thus, in the related art, there are no useful coatings that, without containing chromium, provide moisture absorption resistance, coating tension, and thermal resistance that are comparable to those achieved when a chromium-containing coating is used.

The coating of the coated metal according to aspects of the present invention is a useful coating that, without containing chromium, provides moisture absorption resistance, coating tension, and thermal resistance that are comparable to those achieved when a chromium-containing coating is used. This was confirmed in an experiment, which will be described below.

First, samples were prepared in the following manner. A grain-oriented electrical steel sheet produced using a known method, final-annealed and 0.27 mm in sheet thickness, was sheared to a size of 300 mm×100 mm, and unreacted portions of the annealing separator were removed. Thereafter, stress relief annealing (800° C., 2 hours, $N_2$) was performed.

Next, light pickling with a 5 mass % phosphoric acid aqueous solution was performed, and thereafter the following treatment solutions for tension coating (some of the solutions correspond to examples of the coating-forming treatment solution according to aspects of the present invention) were applied. As described below, treatment solutions 1 to 5 used are treatment solutions for tension coating different from one another.

Treatment solutions 1 to 3: treatment solutions were prepared in each of which 100 parts by mass on a solid basis of an aqueous solution of primary magnesium phosphate, 66.7 parts by mass on a solids basis of colloidal silica, and 33.3 parts by mass of a compound represented by the general formula $M^{I}M^{IV}{}_{2}(M^{V}O_{4})_{3}$ indicated in Table 1 were combined. The compound represented by the general formula $M^{I}M^{IV}{}_{2}(M^{V}O_{4})_{3}$ used was prepared by performing synthesis in advance under known conditions and then pulverizing the resultant and adjusting the particle size, in terms of the average particle diameter, to 1 μm. With regard to the method for measuring the average particle diameter, the measurement was carried out by using a laser diffractive scattering method in accordance with JIS Z 8825:2013. Here, the average particle diameter is the median diameter based on volume.

Treatment solution 4: a treatment solution was prepared in which 100 parts by mass on a solid basis of an aqueous solution of primary magnesium phosphate, 66.7 parts by mass on a solid basis of colloidal silica, and 16.7 parts by mass of chromic anhydride were combined.

Treatment solution 5: a treatment solution was prepared in which 100 parts by mass on a solid basis of an aqueous solution of primary magnesium phosphate and 66.7 parts by mass on a solid basis of colloidal silica were combined.

Each of the treatment solutions prepared as described above was applied to both sides of a grain-oriented electrical steel sheet to yield a dried coating weight on both sides in total of 10 g/m$^2$.

Next, the grain-oriented electrical steel sheet having the treatment solution applied thereto was placed into a drying furnace (300° C., 1 minute) and was then subjected to a heat treatment under the conditions of 800° C., 2 minutes, and a 100% $N_2$ atmosphere.

The tension imparted to the steel sheet, moisture absorption resistance, and thermal resistance of each of the obtained samples were investigated using the methods described below. The tension imparted to the steel sheet was tension in the rolling direction and was calculated by using equation (1) below from the magnitude of deflection of the steel sheet after the coating on one side was removed by using, for example, alkali or acid. Imparted tensions of 10 MPa or greater were rated as good.

$$\text{Imparted tension to steel sheet [MPa]} = \text{Young's modulus of steel sheet [GPa]} \times \text{sheet thickness [mm]} \times \text{magnitude of deflection [mm]} / (\text{deflection measurement length [mm]})^2 \times 10^3 \quad \text{equation (1)}$$

The Young's modulus of the steel sheet was 132 GPa. The deflection measurement length is the length of the portion in which the deflection is measured, that is, the length of the sample in the direction perpendicular to the rolling direction minus the clamping margin for the deflection magnitude measurement jig.

Moisture absorption resistance was evaluated by conducting a phosphorus dissolution test. This test is as follows. Three test pieces of 50 mm×50 mm are cut from a steel sheet immediately after the baking of the tension coating, and the test pieces are boiled in 100° C. distilled water for 5 minutes to cause phosphorus to dissolve from the surface of the tension coating. The tendency of the tension coating to dissolve in water is determined by the amount of dissolution [μg/150 cm$^2$]. Amounts of dissolution of 150 [μg/150 cm$^2$] or less were rated as good.

Thermal resistance was evaluated using a drop weight method. This test is as follows. Test pieces of 50 mm×50 mm are cut, and ten such test pieces are stacked to form a block, which is then annealed at 830° C. for 2 hours in a nitrogen atmosphere under a load of 2 kg/cm$^2$. A 500-g cylindrical weight having a circular bottom surface of 20 mm in diameter is dropped (dropped in the stacking direction) from a height of 20 cm onto the annealed block. When all the ten steel sheets are separated apart by the impact, the test is terminated. When not all the ten pieces are separated apart, the height from which the weight is dropped is increased to 40 cm and then 60 cm, that is, in increments of 20 cm. The evaluation is made by using the drop-weight height [cm] at which all the ten pieces are separated apart. Heights of 40 cm or less were rated as good. In the case that the test pieces were originally separated, the height was 0 cm.

Table 1 shows the results of the measurements of tension imparted to the steel sheet, the amount of phosphorus dissolution, and the drop-weight height.

TABLE 1

| Treatment solution No. | Crystalline compound | Imparted tension [MPa] | Moisture absorption resistance [μg/150 cm$^2$] | Thermal resistance [cm] | Notes |
|---|---|---|---|---|---|
| 1 | $NaZr_2(PO_4)_3$ | 15.0 | 25 | 0 | Invention example |
| 2 | $NaTi_2(PO_4)_3$ | 13.0 | 28 | 0 | Invention example |
| 3 | $MgTi_4(PO_4)_6$ | 12.0 | 20 | 0 | Invention example |
| 4 | None | 8.0 | 20 | 40 | Comparative example |
| 5 | None | 5.0 | 6500 | 120 | Comparative example |

*Underlines indicate scope of invention is not satisfied or result is not good.

The experimental results shown above demonstrate that, when a compound represented by $M^{I}M^{IV}{}_{2}(M^{V}O_{4})_{3}$ is included in the coating, tension imparted to the steel sheet increases, and further, moisture absorption resistance and thermal resistance are improved. In particular, thermal resistance was very good, as indicated by the fact that, even after annealing under a load, there was no adhesion between the steel sheets and thus no need for weight dropping.

The results described above demonstrate that the coating of the coated metal according to aspects of the present invention is a useful coating that, without containing chromium, provides moisture absorption resistance, coating tension, and thermal resistance that are comparable to or higher than those achieved when a chromium-containing coating is used.

Properties such as thermal resistance are properties that can be required of various types of coated metal, and therefore the use of a grain-oriented electrical steel sheet as the metal is exemplary, and it is contemplated that various types of metal may be employed. Examples of other metals include aluminum and stainless steel.

Example 1

A grain-oriented electrical steel sheet, final-annealed and 0.23 mm in sheet thickness, was prepared. The grain-oriented electrical steel sheet was cut into pieces of 100 mm×300 mm, which were then pickled with phosphoric acid. Thereafter, each of the treatment solutions shown in Table 2 was applied by using a roll coater to yield a dried coating weight on both sides in total of 6 g/m$^2$. Thereafter, heat treatments under various conditions shown in Table 2 were carried out. For the heat treatment atmosphere, nitrogen was used.

As the phosphate, an aqueous solution of one or more primary phosphates were used for each. The amounts shown in Table 2 are amounts on a solid basis relative to 100 parts by mass on a solid basis of the total phosphate. Also, the amount of colloidal silica shown is the amount of $SiO_2$ on a solid basis. The compound represented by the general formula $M^{I}M^{IV}{}_{2}(M^{V}O_4)_3$ used was prepared by performing synthesis in advance under known conditions and then pulverizing the resultant and adjusting the particle size, in terms of the average particle diameter, to 1 μm. With regard to the method for measuring the average particle diameter, the measurement was carried out by using a laser diffractive scattering method in accordance with JIS Z 8825:2013. Here, the average particle diameter is the median diameter based on volume.

The properties of each of the grain-oriented electrical steel sheets obtained as described above were investigated in the same manner as the manner of evaluation for Table 1. The results are shown in Table 2.

As shown in Table 2, it is seen that, when a crystal represented by $M^{I}M^{IV}{}_{2}(M^{V}O_4)_3$ is included in the coating, tension imparted to the steel sheet, moisture absorption resistance, and thermal resistance are improved.

In some of the invention examples, the P content in the coating was 10.0 to 36.0 mol % on an oxide basis (on a $P_2O_5$ basis), and the Si content was 28.0 to 63.0 mol % on an oxide basis (on a $SiO_2$ basis) (the same applies to other examples (in the case that there was one invention example, the only one satisfied the above)).

In some of the invention examples, the content of the metal element represented by $M^{IV}$ in the coating was 0.3 to 25.0 mol % on an oxide basis (the same applies to other examples (in the case that there was one invention example, the only one satisfied the above)).

TABLE 2

| No. | Phosphate (parts by mass) Mg phosphate | Ca phosphate | Ba phosphate | Sr phosphate | Zn phosphate | Al phosphate | Mn phosphate | Colloidal silica (parts by mass) | Chromic anhydride (parts by mass) |
|---|---|---|---|---|---|---|---|---|---|
| 1 | 100 | | | | | | | 50 | |
| 2 | 100 | | | | | | | 50 | 15 |
| 3 | 100 | | | | | | | 50 | 15 |
| 4 | 100 | | | | | | | 50 | |
| 5 | 100 | | | | | | | 80 | |
| 6 | 100 | | | | | | | 80 | |
| 7 | 100 | | | | | | | 100 | |
| 8 | 100 | | | | | | | 100 | |
| 9 | 100 | | | | | | | 100 | |
| 10 | 100 | | | | | | | 100 | |
| 11 | 100 | | | | | | | 100 | |
| 12 | 100 | | | | | | | 120 | |
| 13 | 100 | | | | | | | 120 | |
| 14 | 100 | | | | | | | 120 | 20 |
| 15 | | | | | | 100 | | 120 | |
| 16 | | | | | | 100 | | 150 | |
| 17 | | | | | | 100 | | 100 | 20 |
| 18 | | | | | | 100 | | 180 | |
| 19 | | | | | | 100 | | 100 | |
| 20 | | | | | | 100 | | 100 | |
| 21 | | | | | | 100 | | 180 | |
| 22 | 40 | | | | | 60 | | 50 | |
| 23 | | 50 | | | | 50 | | 80 | |
| 24 | | | 100 | | | | | 80 | |
| 25 | | | | 100 | | | | 80 | |
| 26 | | | | | 100 | | | 100 | |
| 27 | 70 | | | | | | 30 | 100 | |
| 28 | 80 | 20 | | | | | | 100 | |
| 29 | 50 | | | | | 50 | | 100 | |
| 30 | 50 | | | | 50 | | | 120 | |
| 31 | | | 50 | 50 | | | | 120 | |
| 32 | 60 | | | | | 40 | | 120 | |

| No. | Crystalline compound Type | Addition amount (parts by mass) | Heat treatment conditions Temperature (° C.) | Duration (s) | Imparted tension [MPa] | Moisture absorption resistance [μg/150 cm$^2$] | Thermal resistance [cm] | Notes |
|---|---|---|---|---|---|---|---|---|
| 1 | None | None | 800 | 30 | 5.0 | 5400 | 100 | Comparative example |
| 2 | None | None | 800 | 20 | 8.0 | 18 | 40 | Comparative example |
| 3 | $KZr_2(PO_4)_3$ | 5 | 800 | 30 | 10.5 | 20 | 20 | Invention example |
| 4 | $KZr_2(PO_4)_3$ | 1 | 800 | 10 | 10.0 | 80 | 40 | Invention example |
| 5 | $CaTi_4(PO_4)_6$ | 5 | 800 | 30 | 10.5 | 60 | 20 | Invention example |
| 6 | $Zr_{2.25}(PO_4)_3$ | 5 | 850 | 30 | 10.5 | 56 | 20 | Invention example |
| 7 | $CaZr_4(PO_4)_6$ | 10 | 850 | 300 | 11.3 | 35 | 0 | Invention example |
| 8 | $MgTiO_3$ | 10 | 850 | 300 | 5.2 | 5200 | 100 | Comparative example |

TABLE 2-continued

| | | | | | | | | |
|---|---|---|---|---|---|---|---|---|
| 9 | $Mg_2P_2O_7$ | 10 | 850 | 300 | 5.2 | 5500 | 100 | Comparative example |
| 10 | $NaHf_2(PO_4)_3$ | 10 | 850 | 30 | 11.5 | 36 | 0 | Invention example |
| 11 | $MgTi_4(PO_4)_6$ | 5 | 900 | 10 | 12.8 | 54 | 20 | Invention example |
| 12 | $MgTi_4(PO_4)_6$ | 10 | 900 | 30 | 14.8 | 32 | 0 | Invention example |
| 13 | $MgTi_4(PO_4)_6$ | 20 | 900 | 60 | 17.8 | 24 | 0 | Invention example |
| 14 | $MgTi_4(PO_4)_6$ | 10 | 900 | 60 | 15.0 | 30 | 0 | Invention example |
| 15 | $LiZr_2(PO_4)_3$ | 10 | 1000 | 10 | 11.2 | 30 | 0 | Invention example |
| 16 | $CaTi_4(PO_4)_6$ | 30 | 1000 | 60 | 15.3 | 11 | 0 | Invention example |
| 17 | $CaTi_4(PO_4)_6$ | 20 | 900 | 30 | 13.5 | 15 | 0 | Invention example |
| 18 | None | None | 1000 | 120 | 5.3 | 8600 | 120 | Comparative example |
| 19 | $AlPO_4$ | 15 | 850 | 60 | 5.1 | 6400 | 120 | Comparative example |
| 20 | $MgAl_2O_4$ | 15 | 850 | 60 | 5.1 | 6250 | 120 | Comparative example |
| 21 | $MgTi_4(PO_4)_6$ | 40 | 1000 | 300 | 18.2 | 18 | 0 | Invention example |
| 22 | $NbZr(PO_4)_3$ | 50 | 800 | 30 | 19.3 | 20 | 0 | Invention example |
| 23 | $CaZr_4(PO_4)_6$ | 40 | 900 | 30 | 18.1 | 22 | 0 | Invention example |
| 24 | None | None | 900 | 30 | 5.5 | 4850 | 100 | Comparative example |
| 25 | $SrZr_4(PO_4)_6$ | 40 | 900 | 5 | 17.5 | 23 | 0 | Invention example |
| 26 | $KTi_2(PO_4)_3$ | 30 | 950 | 30 | 14.8 | 36 | 0 | Invention example |
| 27 | $MgTi_4(PO_4)_6$ | 30 | 950 | 30 | 15.2 | 34 | 0 | Invention example |
| 28 | $CaZr_4(PO_4)_6$ | 30 | 1000 | 30 | 17.5 | 33 | 0 | Invention example |
| 29 | $MgTi_4(PO_4)_6$ | 20 | 850 | 180 | 15.6 | 39 | 0 | Invention example |
| 30 | $MgTi_4(PO_4)_6$ | 20 | 850 | 20 | 15.4 | 36 | 0 | Invention example |
| 31 | $SrZr_4(PO_4)_6$ | 10 | 900 | 10 | 13.5 | 40 | 20 | Invention example |
| 32 | $MgTi_4(PO_4)_6$ | 10 | 900 | 140 | 14.9 | 42 | 20 | Invention example |

*Underlines indicate scope of invention is not satisfied or result is not good.

Example 2

A grain-oriented electrical steel sheet, final-annealed and 0.23 mm in sheet thickness, was prepared. The grain-oriented electrical steel sheet was cut into pieces of 100 mm×300 mm, which were then pickled with phosphoric acid. Thereafter, each of the treatment solutions shown in Table 3 was applied by using a roll coater to yield a dried coating weight on both sides in total of 14 g/m$^2$. Thereafter, the first heat treatment was carried out at 800° C. for 60 seconds in a nitrogen atmosphere. For the treatment, the duration of holding at 600° C. to 700° C. was 5 seconds. Properties after the first heat treatment were investigated in the same manner as the manner of evaluation for Table 1, and the results are shown in Table 3.

After the first heat treatment, the second heat treatment was carried out in a nitrogen atmosphere, at the temperature and for the duration shown in Table 3. Properties after the second heat treatment were investigated in the same manner as the manner of evaluation for Table 1, and the results are shown in Table 3.

The $TiO_2$ sol used was NTB-100, manufactured by Showa Titanium Co., Ltd., and the $ZrO_2$ sol used was NanoUse ZR, manufactured by Nissan Chemical Industries, Ltd. By using a dynamic light scattering method, it was determined that the primary particle diameter was not greater than 100 nm. All of the sols were crystalline sols.

The amounts of the components shown in Table 3 are expressed in parts by mass per 100 parts by mass on a solid basis of the phosphate.

Figure 2:
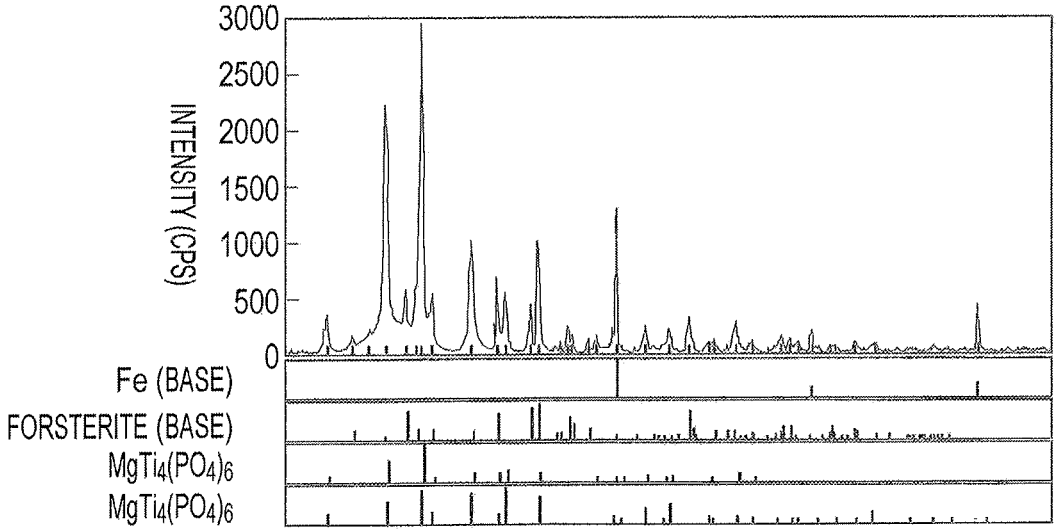
FIG. 2 is an exemplary chart illustrating the X-ray diffraction of a coating after a second heat treatment.

For the identification of the crystal phase, thin-film X-ray diffraction was used. By way of example, the diffraction peaks of No. 4 after the first heat treatment are shown in FIG. 1, and the diffraction peaks thereof after the second heat treatment are shown in FIG. 2.

TABLE 3

| | Phosphate (parts by mass) | | | Colloidal silica | $TiO_2$ (parts | $ZrO_2$ (parts | Properties after first heat treatment | | |
|---|---|---|---|---|---|---|---|---|---|
| No. | Mg phosphate | Ca phosphate | Al phosphate | (parts by mass) | by mass) | by mass) | Imparted tension [MPa] | Moisture absorption resistance [μg/150 cm$^2$] | Thermal resistance [cm] |
| 1 | 100 | | | 80 | | | 5.0 | 3200 | 100 |
| 2 | 100 | | | 80 | | | 5.0 | 3200 | 100 |
| 3 | 100 | | | 80 | 5 | | 5.2 | 3300 | 100 |
| 4 | 100 | | | 80 | 30 | | 5.2 | 3300 | 100 |
| 5 | 100 | | | 80 | 50 | | 5.1 | 3150 | 100 |
| 6 | 100 | | | 80 | | 10 | 5.0 | 3280 | 100 |
| 7 | 100 | | | 80 | | 20 | 4.9 | 3400 | 100 |
| 8 | 100 | | | 80 | | 40 | 4.9 | 3260 | 100 |
| 9 | 100 | | | 80 | 20 | 20 | 5.0 | 3400 | 100 |
| 10 | | | 100 | 80 | | | 4.8 | 2500 | 120 |
| 11 | | | 100 | 80 | | 10 | 4.8 | 2800 | 120 |
| 12 | | | 100 | 80 | | 20 | 4.8 | 2600 | 120 |
| 13 | | | 100 | 80 | | 40 | 4.8 | 2890 | 120 |
| 14 | 40 | | 60 | 80 | 10 | | 5.0 | 2930 | 120 |
| 15 | | 50 | 50 | 80 | 10 | | 4.9 | 3120 | 120 |
| 16 | | 100 | | 80 | 20 | | 4.9 | 3200 | 120 |
| 17 | | 100 | | 80 | | 20 | 4.9 | 3120 | 120 |
| 18 | | 100 | | 80 | 10 | 10 | 4.9 | 2980 | 120 |

TABLE 3-continued

| | | | | | | | | | |
|---|---|---|---|---|---|---|---|---|---|
| 19 | 50 | | 50 | 80 | 15 | | 5.0 | 3420 | 120 |
| 20 | 80 | 20 | | 80 | 20 | | 5.1 | 3360 | 100 |
| 21 | 50 | | 50 | 80 | | | 5.0 | 3440 | 120 |
| 22 | 50 | | 50 | 80 | | 40 | 4.7 | 3320 | 120 |
| 23 | 50 | 50 | | 80 | 20 | | 5.0 | 2890 | 100 |
| 24 | 100 | | | 80 | 30 | | 5.2 | 3300 | 100 |
| 25 | | | 100 | 80 | | 10 | 4.8 | 2800 | 120 |

| | Second heat treatment conditions | | | | Properties after second heat treatment | | | |
|---|---|---|---|---|---|---|---|---|
| No. | Holding duration in temperature range of 600 to 700° C. | Baking temperature (° C.) | Baking duration (s) | Crystal phase Type | Imparted tension [MPa] | Moisture absorption resistance [μg/150 cm$^2$] | Thermal resistance [cm] | Notes |
| 1 | None | None | None | None | — | — | — | Comparative example |
| 2 | 10 | 1000 | 30 | $Mg_2P_2O_7$ | 7.5 | 200 | 60 | Comparative example |
| 3 | 30 | 900 | 120 | $MgTi_4(PO_4)_6$ | 12.0 | 15 | 0 | Invention example |
| 4 | 30 | 900 | 120 | $MgTi_4(PO_4)_6$ | 12.3 | 15 | 0 | Invention example |
| 5 | 30 | 900 | 120 | $MgTi_4(PO_4)_6$ | 15.1 | 15 | 0 | Invention example |
| 6 | 45 | 950 | 60 | $Zr_{2.25}(PO_4)_3$ | 12.1 | 18 | 0 | Invention example |
| 7 | 60 | 950 | 60 | $Zr_{2.25}(PO_4)_3$ | 13.6 | 16 | 0 | Invention example |
| 8 | 20 | 1000 | 30 | $Zr_{2.25}(PO_4)_3$ | 15.3 | 10 | 0 | Invention example |
| 9 | 30 | 850 | 60 | $MgTi_4(PO_4)_6$ $Zr_{2.25}(PO_4)_3$ | 12.5 | 17 | 0 | Invention example |
| 10 | 10 | 900 | 180 | $AlPO_4$ | 7.2 | 160 | 60 | Comparative example |
| 11 | 10 | 900 | 180 | $Zr_{2.25}(PO_4)_3$ | 12.3 | 11 | 0 | Invention example |
| 12 | 12 | 900 | 180 | $Zr_{2.25}(PO_4)_3$ | 13.2 | 13 | 0 | Invention example |
| 13 | 25 | 1000 | 360 | $Zr_{2.25}(PO_4)_3$ | 16.2 | 10 | 0 | Invention example |
| 14 | 25 | 900 | 30 | $Zr_{2.25}(PO_4)_3$ | 12.4 | 17 | 0 | Invention example |
| 15 | 30 | 900 | 30 | $CaTi_4(PO_4)_6$ | 12.3 | 22 | 0 | Invention example |
| 16 | 35 | 900 | 30 | $CaTi_4(PO_4)_6$ | 13.6 | 13 | 0 | Invention example |
| 17 | 55 | 900 | 5 | $CaZr_4(PO_4)_6$ | 13.8 | 14 | 0 | Invention example |
| 18 | 45 | 950 | 30 | $CaZr_4(PO_4)_6$ | 12.6 | 11 | 0 | Invention example |
| 19 | 50 | 950 | 30 | $MgTi_4(PO_4)_6$ | 16.1 | 12 | 0 | Invention example |
| 20 | 60 | 1000 | 30 | $MgTi_4(PO_4)_6$ | 15.8 | 18 | 0 | Invention example |
| 21 | 20 | 850 | 180 | None | 7.8 | 3200 | 80 | Comparative example |
| 22 | 30 | 850 | 20 | $Zr_{2.25}(PO_4)_3$ | 13.4 | 15 | 0 | Invention example |
| 23 | 20 | 900 | 10 | $MgTi_4(PO_4)_6$ | 13.5 | 16 | 0 | Invention example |
| 24 | 20 | 780 | 30 | None | 5.4 | 3000 | 100 | Comparative example |
| 25 | 8 | 900 | 20 | None | 6.0 | 2900 | 100 | Comparative example |

*Underlines indicate scope of invention is not satisfied or result is not good.

As shown in Table 3, it is seen that, when the second heat treatment is performed and a crystal represented by $M^{I}M^{IV}{}_2(M^{V}O_4)_3$ is included in the coating, tension imparted to the steel sheet, moisture absorption resistance, and thermal resistance are dramatically improved.

Example 3

100 parts by mass of primary magnesium phosphate, 80 parts by mass of colloidal silica, 5 parts by mass of titanium oxide, each on a solid basis, and 20 parts by mass on a solid basis of 85 mass % orthophosphoric acid were thoroughly mixed together in a quartz beaker and evaporated to dryness on a hot plate set at 200° C. Next, the resultant solid was melted in a platinum crucible at 1450° C. for 2 hours, and thereafter the melt was poured onto an iron plate and rapidly quenched to obtain glass. After quenching, the glass was pulverized, and the particle size was reduced to 5 μm or less. The particle size was measured by using a laser diffractive scattering method in accordance with JIS Z 8825:2013, and it was determined that the 90% particle diameter was 5.0 μm or less.

The glass powder (glass frit) obtained as described above was suspended in ethanol and was applied, by using a bar coater, to the surface of each of two pieces of ferritic stainless steel JFE 430XT, manufactured by JFE Steel Corporation. The two pieces each measured 100 mm×100 mm×0.5 mm in thickness. The amount of coating was adjusted to yield a dried coating weight per side of 5 g/m$^2$.

The steel sheets after coating and drying (100° C.×2 minutes) were subjected to the first heat treatment at 1000° C. for 30 minutes in a nitrogen atmosphere, and thus the glass coating was formed uniformly on the surface of each of the steel sheets (sample A). Further, one of the steel sheets was then subjected to the second heat treatment at 800° C. for 180 minutes in a nitrogen atmosphere (sample B).

In the case that the coating is formed by preparing glass frit and making powder therefrom, the reaction takes time. Thus, to investigate whether the coating obtained in this manner was established as a coating and whether the desired crystal structure was formed, investigation of insulating properties, adhesion between the coating and the steel sheet, and moisture absorption resistance was carried out and identification of the crystal phase was carried out using X-ray diffraction. The results are shown in Table 4. Evaluations of the properties were made as follows.

Insulating properties: a test was conducted using the surface resistance measurement method described in JIS C2550-4. Current values (Franklin current values) of 0.20 A or less were determined to be good. In view of the influence of moisture absorption resistance, the test was conducted after the samples were left in the office for one month after the coating was formed.

Adhesion: the Cross-cut method of JIS K5600 5-6 was used. The adhesive tape used was Cellotape (registered trademark) CT-18 (adhesive force: 4.01 N/10 mm). Of 2 mm×2 mm squares, the number of peeled squares is shown in Table 6. If four or more squares were peeled off, such cases were rated as defective.

The method for evaluating moisture absorption resistance is as described above, and therefore a description thereof is omitted.

TABLE 4

| No. | Crystal phase | Insulating properties [A] | Adhesion | Moisture absorption resistance [μg/150 cm$^2$] | Notes |
|---|---|---|---|---|---|
| A | None | 0.25 | 3 | 2500 | Comparative example |
| B | $MgTi_4(PO_4)_6$ | 0.05 | 2 | 10 | Invention example |

*Underlines indicate scope of invention is not satisfied or result is not good.

As shown in Table 4, the coating after crystallization had excellent moisture absorption resistance and good insulating properties and adhesion and was established as a coating, and therefore it is seen that the coating can be used as various types of inorganic coatings.

The invention claimed is:

1. Coated metal, the metal including metal and a coating formed on the metal, the coating comprising Si, P, and O, and at least one selected from the group consisting of Mg, Ca, Ba, Sr, Zn, Al, and Mn the coating comprising a compound having a Na Super Ionic Conductor-type (NASICON-type) crystal structure represented by a general formula $M^IM^{IV}{}_2(M^VO_4)_3$, wherein, in the general formula $M^IM^{IV}{}_2(M^VO_4)_3$, $M^I$ is at least one selected from the group consisting of Li, Na, K, ½Mg, ½Ca, ½Sr, and ¼Zr, $M^{IV}$ is at least one selected from the group consisting of Zr, Ge, Ti, Hf, Cr+Na, Nb—Na, and Y+Na, and My is at least one selected from the group consisting of P, As, and Si+Na.

2. The coated metal according to claim 1, wherein the coating is a chromium-free coating, free of Cr.

3. The coated metal according to claim 2, wherein the metal comprises a steel sheet.

4. The coated metal according to claim 3, wherein the steel sheet comprises a grain-oriented electrical steel sheet.

5. A method for producing the coated metal according to claim 3, the method comprising:

applying a coating-forming treatment solution onto the metal; and subjecting the metal to at least one heat treatment in a non-oxidizing atmosphere, wherein the coating-forming treatment solution comprising:

at least one metal phosphate selected from the group consisting of Mg, Ca, Ba, Sr, Zn, Al, and Mn;

colloidal silica; and a compound having a Na Super Ionic Conductor-type (NASICON-type) crystal structure represented by general formula $M^IM^{IV}{}_2(M^VO_4)_3$, wherein, in the general formula $M^IM^{IV}{}_2(M^VO_4)_3$, $M^I$ is at least one selected from the group consisting of Li, Na, K, ½Mg, ½Ca, ½Sr, and ¼Zr, $M^{IV}$ is at least one selected from the group consisting of Zr, Ge, Ti, Hf, Cr+Na, Nb—Na, and Y+Na, and My is at least one selected from the group consisting of P, As, and Si+Na.

6. A method for producing the coated metal according to claim 3, the method comprising:

applying a coating-forming treatment solution onto the metal, the coating-forming treatment solution including at least one metal phosphate selected from the group consisting of Mg, Ca, Ba, Sr, Zn, Al, and Mn, colloidal silica, and a metal sol having a primary particle diameter of 100 nm or less; and after the application, subjecting the metal to at least one heat treatment in a non-oxidizing atmosphere, wherein the heat treatment is a process in which the metal is held in a temperature range of 600° C. or higher and 700° C. or lower for 10 seconds or more and 60 seconds or less, and, after the holding, baking is performed thereon at 800° C. or higher.

7. A method for producing the coated metal according to claim 3, the method comprising:

applying a glass-coating-forming treatment solution containing glass powder onto the metal; and thereafter, subjecting the metal to at least one heat treatment in a non-oxidizing atmosphere.

8. A method for producing the coated metal according to claim 2, the method comprising:

applying a coating-forming treatment solution onto the metal; and subjecting the metal to at least one heat treatment in a non-oxidizing atmosphere, wherein the coating-forming treatment solution comprising:

at least one metal phosphate selected from the group consisting of Mg, Ca, Ba, Sr, Zn, Al, and Mn;

colloidal silica; and a compound having a Na Super Ionic Conductor-type (NASICON-type) crystal structure represented by general formula $M^IM^{IV}{}_2(M^VO_4)_3$, wherein, in the general formula $M^IM^{IV}{}_2(M^VO_4)_3$, $M^I$ is at least one selected from the group consisting of Li, Na, K, ½Mg, ½Ca, ½Sr, and ¼Zr, $M^{IV}$ is at least one selected from the group consisting of Zr, Ge, Ti, Hf, Cr+Na, Nb—Na, and Y+Na, and $M^V$ is at least one selected from the group consisting of P, As, and Si+Na.

9. A method for producing the coated metal according to claim 2, the method comprising:

applying a coating-forming treatment solution onto the metal, the coating-forming treatment solution including at least one metal phosphate selected from the group consisting of Mg, Ca, Ba, Sr, Zn, Al, and Mn, colloidal silica, and a metal sol having a primary particle diameter of 100 nm or less; and after the application, subjecting the metal to at least one heat treatment in a non-oxidizing atmosphere, wherein the heat treatment is a process in which the metal is held in a temperature range of 600° C. or higher and 700° C. or lower for 10 seconds or more and 60 seconds or less, and, after the holding, baking is performed thereon at 800° C. or higher.

10. A method for producing the coated metal according to claim 2, the method comprising:

applying a glass-coating-forming treatment solution containing glass powder onto the metal; and thereafter, subjecting the metal to at least one heat treatment in a non-oxidizing atmosphere.

11. The coated metal according to claim 1, wherein the metal comprises a steel sheet.

12. The coated metal according to claim 11, wherein the steel sheet comprises a grain-oriented electrical steel sheet.

13. A method for producing the coated metal according to claim 11, the method comprising:

applying a coating-forming treatment solution onto the metal; and subjecting the metal to at least one heat treatment in a non-oxidizing atmosphere, wherein the coating-forming treatment solution comprising:

at least one metal phosphate selected from the group consisting of Mg, Ca, Ba, Sr, Zn, Al, and Mn;

colloidal silica; and a compound having a Na Super Ionic Conductor-type (NASICON-type) crystal structure represented by a general formula $M^{I}M^{IV}{}_{2}(M^{V}O_{4})_{3}$, wherein, in the general formula $M^{I}m^{IV}{}_{2}(m^{V}O_{4})_{3}$, $M^{I}$ is at least one selected from the group consisting of Li, Na, K, ½Mg, ½Ca, ½Sr, and ¼Zr, $M^{IV}$ is at least one selected from the group consisting of Zr, Ge, Ti, Hf, Cr+Na, Nb—Na, and Y+Na, and $M^{V}$ is at least one selected from the group consisting of P, As, and Si+Na.

14. A method for producing the coated metal according to claim 11, the method comprising:

applying a coating-forming treatment solution onto the metal, the coating-forming treatment solution including at least one metal phosphate selected from the group consisting of Mg, Ca, Ba, Sr, Zn, Al, and Mn, colloidal silica, and a metal sol having a primary particle diameter of 100 nm or less; and after the application, subjecting the metal to at least one heat treatment in a non-oxidizing atmosphere, wherein the heat treatment is a process in which the metal is held in a temperature range of 600° C. or higher and 700° C. or lower for 10 seconds or more and 60 seconds or less, and, after the holding, baking is performed thereon at 800° C. or higher.

15. A method for producing the coated metal according to claim 11, the method comprising:

applying a glass-coating-forming treatment solution containing glass powder onto the metal; and thereafter, subjecting the metal to at least one heat treatment in a non-oxidizing atmosphere.

16. A method for producing the coated metal according to claim 1, the method comprising:

applying a coating-forming treatment solution onto the metal; and subjecting the metal to at least one heat treatment in a non-oxidizing atmosphere, wherein the coating-forming treatment solution comprising:

at least one metal phosphate selected from the group consisting of Mg, Ca, Ba, Sr, Zn, Al, and Mn;

colloidal silica; and a compound having a Na Super Ionic Conductor-type (NASICON-type) crystal structure represented by general formula $M^{I}M^{IV}{}_{2}(M^{V}O_{4})_{3}$, wherein, in the general formula $M^{I}M^{IV}{}_{2}(M^{V}O_{4})_{3}$, $M^{I}$ is at least one selected from the group consisting of Li, Na, K, ½Mg, ½Ca, ½Sr, and ¼Zr, $M^{IV}$ is at least one selected from the group consisting of Zr, Ge, Ti, Hf, Cr+Na, Nb—Na, and Y+Na, and $M^{V}$ is at least one selected from the group consisting of P, As, and Si+Na.

17. A method for producing the coated metal according to claim 1, the method comprising:

applying a coating-forming treatment solution onto the metal, the coating-forming treatment solution including at least one metal phosphate selected from the group consisting of Mg, Ca, Ba, Sr, Zn, Al, and Mn, colloidal silica, and a metal sol having a primary particle diameter of 100 nm or less; and after the application, subjecting the metal to at least one heat treatment in a non-oxidizing atmosphere, wherein the heat treatment is a process in which the metal is held in a temperature range of 600° C. or higher and 700° C. or lower for 10 seconds or more and 60 seconds or less, and, after the holding, baking is performed thereon at 800° C. or higher.

18. A method for producing the coated metal according to claim 1, the method comprising:

applying a glass-coating-forming treatment solution containing glass powder onto the metal; and thereafter, subjecting the metal to at least one heat treatment in a non-oxidizing atmosphere.

* * * * *